US010774483B2

(12) United States Patent
Tunis, III et al.

(10) Patent No.: US 10,774,483 B2
(45) Date of Patent: Sep. 15, 2020

(54) DEVICE TO PROVIDE PROTECTION OF A STRUCTURAL MEMBER AGAINST A CUTTING THREAT

(71) Applicants: Hardwire, LLC, Pocomoke City, MD (US); George C. Tunis, III, Pocomoke City, MD (US)

(72) Inventors: George C. Tunis, III, Ocean City, MD (US); Frank A. Baker, IV, Salisbury, MD (US); Tim Keller, Salisbury, MD (US)

(73) Assignee: Hardwire, LLC, Pocomoke City, MD (US)

( * ) Notice: Subject to any disclaimer, the term of this patent is extended or adjusted under 35 U.S.C. 154(b) by 80 days.

(21) Appl. No.: 16/220,087

(22) Filed: Dec. 14, 2018

(65) Prior Publication Data

US 2019/0186090 A1 Jun. 20, 2019

Related U.S. Application Data

(60) Provisional application No. 62/598,690, filed on Dec. 14, 2017.

(51) Int. Cl.

| | |
|---|---|
| ***E01D 11/02*** | (2006.01) |
| ***E01D 19/06*** | (2006.01) |
| ***D07B 5/00*** | (2006.01) |
| ***D07B 1/16*** | (2006.01) |
| ***D07B 1/00*** | (2006.01) |
| *E01D 19/16* | (2006.01) |
| *E04H 9/00* | (2006.01) |

(Continued)

(52) U.S. Cl.

CPC ..... *E01D 11/02* (2013.01); *D07B 1/00* (2013.01); *D07B 1/16* (2013.01); *D07B 5/005* (2013.01); *E01D 19/06* (2013.01); *D07B 1/025* (2013.01); *D07B 2201/2085* (2013.01); *D07B 2201/2086* (2013.01); *D07B 2201/2091* (2013.01); *D07B 2201/2092* (2013.01); *D07B 2501/203* (2013.01); *E01C 11/00* (2013.01); *E01D 19/16* (2013.01); *E04H 9/00* (2013.01)

(58) Field of Classification Search

CPC ..... E01D 11/02; E01D 19/16; E01D 19/06; D07B 1/00; D07B 5/005; D07B 1/16; D07B 2201/2091; D07B 1/025; D07B 2501/203; D07B 2201/2086; D07B 2201/2085; D07B 2201/2092; E01C 11/00; E04H 9/00

USPC ..... 52/834

See application file for complete search history.

(56) References Cited

U.S. PATENT DOCUMENTS 4,467,879 A * 8/1984 Burge ..... E21B 17/22 175/325.4

4,807,302 A * 2/1989 Cannella ..... A63B 71/145 2/16

(Continued)

OTHER PUBLICATIONS

Thermal Lance—en.wikipedia.org/wiki/Thermal_lance , available at least as early as Dec. 14, 2018.

*Primary Examiner* — Jeanette E Chapman

(74) *Attorney, Agent, or Firm* — Verrill Dana, LLP

(57) ABSTRACT

A device to protect a structural member against a cutting threat, such as a saw blade or thermal cutting device, is provided. The device provides a substrate having a cavity disposed therein. A cutting resistant element is disposed within the cavity to impede cutting of a cutting device, such as a saw blade or thermal cutting device, into the cutting resistant element.

22 Claims, 10 Drawing Sheets

(51) Int. Cl.
*E01C 11/00* (2006.01)
*D07B 1/02* (2006.01)

(56) References Cited

U.S. PATENT DOCUMENTS 4,848,202 A * 7/1989 Crampton ..... B23D 35/008
83/343
6,050,077 A * 4/2000 Muller ..... A63B 29/028
57/210
6,786,123 B1 * 9/2004 Chen ..... B26D 1/185
83/485
7,748,307 B2 7/2010 Hallissy et al.
7,849,780 B1 12/2010 Hallissy et al.
8,769,882 B2 * 7/2014 Ebaugh ..... E01D 19/16
52/173.1
8,795,832 B2 8/2014 Fyfe et al.
9,782,002 B2 * 10/2017 Cattaneo ..... A47B 96/07

* cited by examiner

DEVICE TO PROVIDE PROTECTION OF A STRUCTURAL MEMBER AGAINST A CUTTING THREAT

CROSS REFERENCE TO RELATED APPLICATIONS

N/A

STATEMENT REGARDING FEDERALLY SPONSORED RESEARCH OR DEVELOPMENT

N/A

BACKGROUND

Structures such as buildings and bridges are considered a potential target for attack. For example, mechanical cutting is an identified threat against bridge cables, in which a hand-held, rotary or reciprocating blade power saw could be used in an attempt to cut destructively through a cable or other structural element. One approach to protecting bridges is to provide structural hardening for the cable elements in suspension and cable-stayed bridges, including main cables, vertical suspender ropes, and stay cables. One example of a protection system for cables is described in U.S. Pat. No. 8,769,882. Such known cable hardening systems are designed to delay a cutting threat for a given amount of time.

Thermal cutting devices, such as a thermal lance, thermic lance, or exothermic torch, can also be used for cutting steel and concrete and can pose a threat to structures. For example, a thermal lance is formed from a steel tube packed with steel or aluminum rods as a fuel source. Oxygen is pumped through the tube and feeds combustion on the opposite end, where the cutting action occurs. The thermal lance can provide a formidable cutting threat, because of the high temperatures it can attain, for example, between 4950° F. and 8130° F. or even higher, depending on the components and environment. Other thermal cutting devices include a plasma torch, an oxy/acetylene torch, and a petrogen torch.

SUMMARY OF THE INVENTION

The invention relates to a device for protecting a structural element from cutting threats, such as a saw blade or a thermal cutting device. The device includes a substrate and a cavity disposed within the substrate. A cutting resistant element is maintained under compression within the cavity by a compressive force extending along an axis of the cavity. The cutting resistant element can also be constrained within the cavity from buckling or bending. In some embodiments, when a saw blade cuts into the cutting resistant element, cut surfaces of the cutting resistant element exert a compressive stress on opposed surfaces of the saw blade, tending to slow and stop the blade from making further cutting progress. The saw blade can also become jammed within the device, such that it is difficult or impossible to remove. In some embodiments, when a thermal cutting device cuts into the cutting resistant element, cut surfaces of the cutting resistant element continue to feed material into the cutting region, impeding advancement of the thermal cutting device.

In some embodiments, the device can be located to protect a structural element such as a cable. In some embodiments, the entire device or the cutting resistant element of the device can serve as a structural or load-bearing component within a structure. The device can be located with the cutting resistant element at any orientation, such as horizontal, vertical, or any orientation between horizontal and vertical.

The cutting resistant element can be maintained under compression in a variety of ways. In some embodiments, a compressive loading element, such as a spring or elastomeric element, can be disposed within the cavity. In some embodiments, the cutting resistant element can be formed of an elastomeric material and loaded within the cavity under compression. In some embodiments, the cutting resistant element can be oriented vertically such that gravity can provide the compressive loading. In some embodiments, the substrate can be post tensioned to provide the compressive loading on the cutting resistant element.

DESCRIPTION OF THE DRAWINGS

The invention will be more fully understood from the following detailed description taken in conjunction with the accompanying drawings in which.

DETAILED DESCRIPTION OF THE INVENTION

Figure 1:
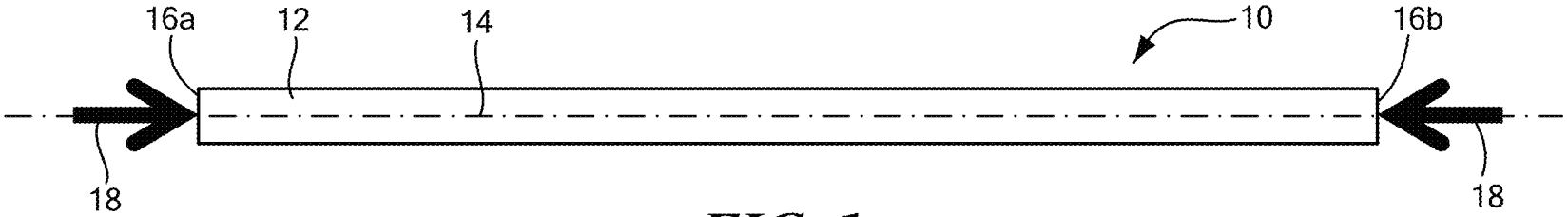
FIG. 1 is a schematic illustration of a cutting resistant element under compressive stress.

An embodiment of a device 10 for protecting a structural element from cutting with a cutting device is described by reference to schematic illustrations in FIGS. 1-3. FIG. 1 illustrates a cutting resistant element 12 extending along an axis 14 defining a direction of elongation between opposed end faces 16*a*, 16*b*. The cutting resistant element can suitably be an elongated element such as a rod or bar and can have any cross-sectional configuration, such as circular, oval, square, or rectangular. In some embodiments, a circular rod is suitable. The cutting resistant element is maintained under compression, indicated schematically by arrows 18 illustrating a compressive force, or stress, on the opposed end faces 16*a*, 16*b* of the cutting resistant element 12.

Figure 2:
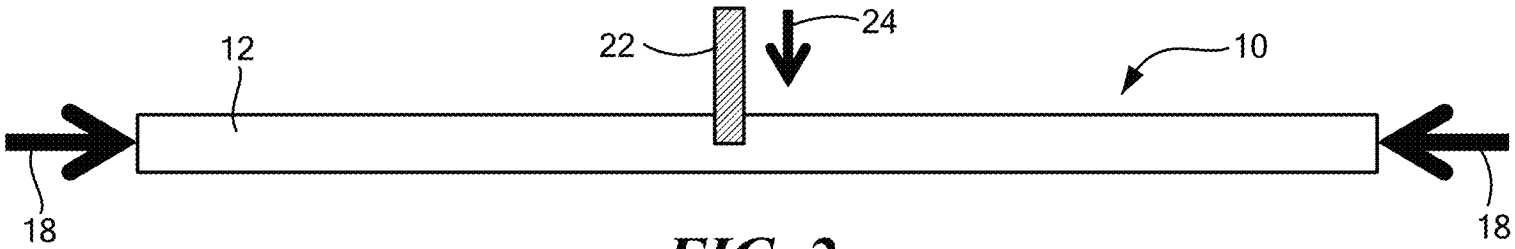
FIG. 2 is a schematic illustration of the cutting resistant element being cut by a saw blade.
Figure 3:
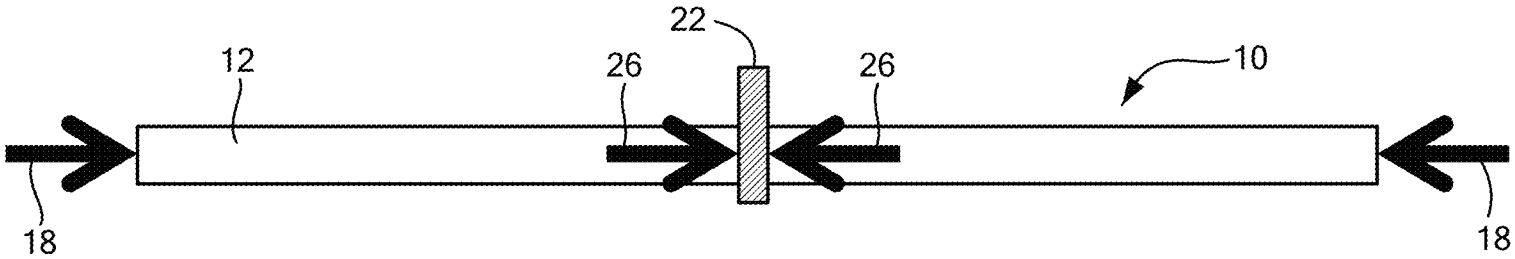
FIG. 3 is a schematic illustration of the cutting resistant element clamping the saw blade.

FIG. 2 schematically indicates a cutting device, such as a saw blade 22, cutting into the cutting resistant element 12, indicated by arrow 24. The saw blade can rotate or reciprocate. In FIG. 3, the saw blade has cut fully through the thickness of the cutting resistant element. Because the cutting resistant element is maintained under compression, opposed cut surfaces of the blade gripping element apply compressive stresses on opposed surfaces of the saw blade, indicated by arrows 26, gripping or clamping the saw blade 22 and impeding its motion. In particular, the compressive stresses 24 can have one or more of three effects: slowing the motion of the blade, stopping the motion of the blade, and jamming the blade so that it cannot be removed from the blade gripping element.

Figure 4:
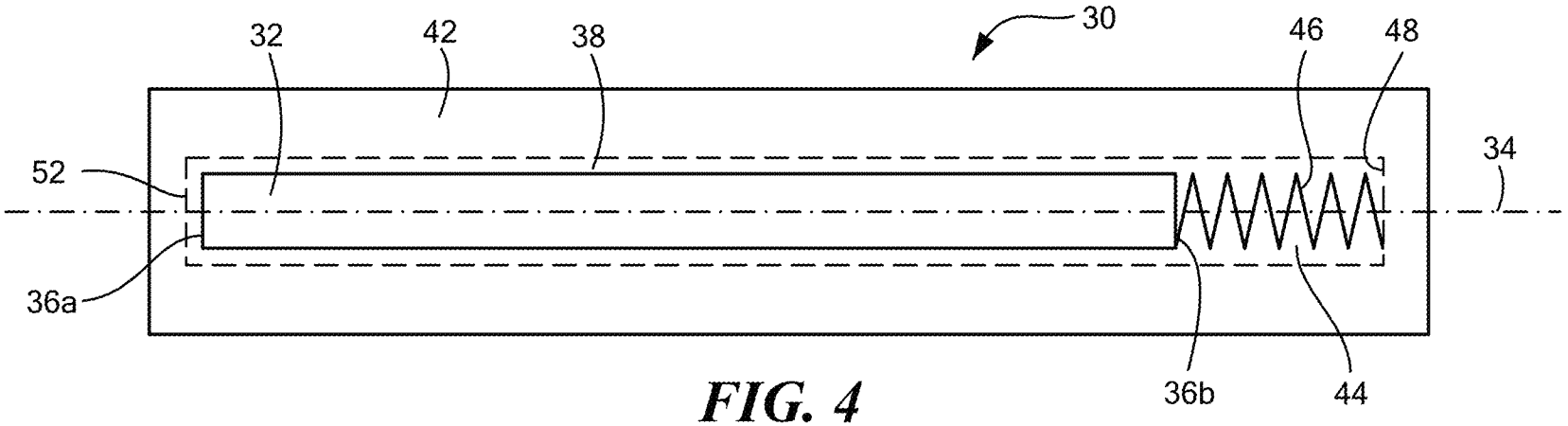
FIG. 4 is a schematic illustration of an embodiment of a device incorporating a cutting resistant element maintained under compression in a cavity.

One embodiment of a device 30 for protecting a structural element from cutting with a cutting device is illustrated schematically in FIG. 4. A cutting resistant element 32 extends along an axis 34 defining a direction of elongation between opposed end faces 36*a*, 36*b*. The cutting resistant element is disposed within a cavity 38 in a substrate 42. The cavity is sized to generally conform to the shape of the cutting resistant element to allow the cutting resistant element to translate along the axis 34 within the cavity. The cross-sectional configuration of the cavity (orthogonal to the axis) is sized and configured to generally conform to the cross sectional configuration of the cutting resistant element to prevent or minimize buckling or bending or other movement of the cutting resistant element transverse to the axis 34. In the embodiment shown, the cavity 38 has a length longer than the length of the cutting resistant element 32 to provide a space 44 at one or both ends for a compressive loading element 46. In the embodiment shown, the compressive loading element is a compression spring disposed between an end face 36*b* of the cutting resistant element 32 and a stop 48 provided by an end wall of the cavity 38. Under the loading of the compression spring, the opposite end face 36*a* of the cutting resistant element 32 is forced into contact with an opposite end wall 52 of the cavity, which serves as a stop. In this manner, the cutting resistant element is maintained under compression within the cavity. (For purposes of clarity of illustration, a gap is shown between the end wall 52 and the opposite face of the cutting resistant element in FIGS. 4 and 5; it will be appreciated that when the cutting resistant element is maintained under compression, this gap would not be present.)

Figure 5:
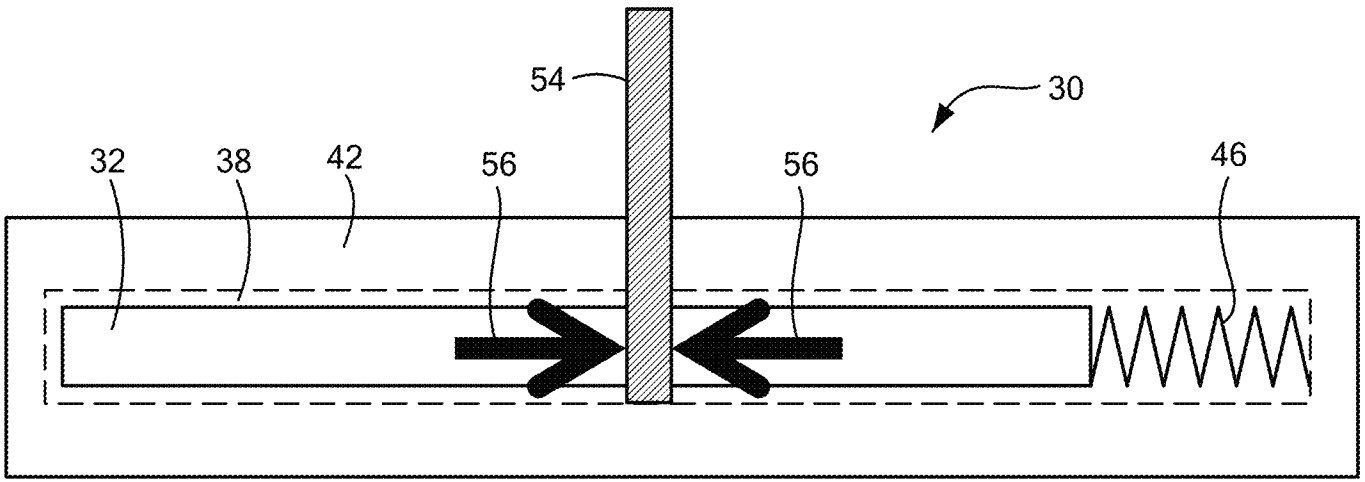
FIG. 5 is a schematic illustration of the device of FIG. 4 showing the cutting resistant element clamping a saw blade.

Referring to FIG. 5, a cutting device such as a saw blade 54 is illustrated cutting through the substrate 42 and the cutting resistant element 32 of the device of FIG. 4. Once the saw blade cuts fully through the cutting resistant element, the cutting resistant element is fully activated, such that the opposed cut surfaces of the cutting resistant element apply opposed compressive stresses, indicated by arrows 56, on the saw blade 34, gripping or clamping the saw blade and impeding its motion. In some embodiments, the cutting resistant element can be formed of a metal or metal alloy, concrete, a reinforced composite material, or an elastomeric material. In some embodiments, the cutting resistant element can be formed of steel, aluminum, or an aluminum alloy.

In some embodiments, the compressive loading element can be two or more compression springs arranged in series linearly in the space in the cavity. In some embodiments, the compressive loading element can be an elastic element, such as a block of rubber or other elastomeric material maintained under compression within the space of the cavity. In some embodiments, the compressive stress can be realized by preloading the cutting resistant element within the cavity. In some embodiments, the cutting resistant element can be formed in whole or in part from an elastomeric material, such as a rubber. In this case, the elastic compressive nature of the cutting resistant element provides the compressive stress.

In some embodiments, one or more post tensioned members can be provided within the substrate to create a compressive strain on the cutting resistant member. Post tensioning is used in concrete structures to place the concrete in compression, and thus avoid the tensile weakness of the concrete. In some embodiments, post tensioning elements can be steel tendons, which are strong in tension.

Figure 6:
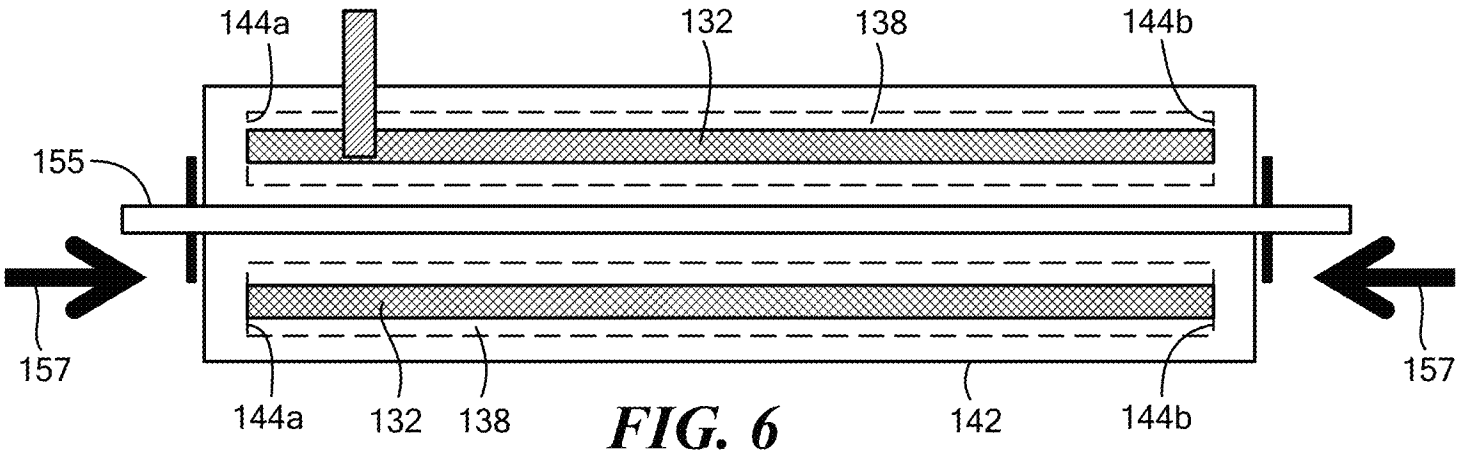
FIG. 6 is a schematic illustration of an embodiment of a device incorporating a cutting resistant element under compressive stress from a post tensioned member.

FIG. 6 illustrates an embodiment using a post tensioned member. In FIG. 6, two cutting resistant elements 132 are each disposed within an associated cavity 138 within a substrate 142. The cutting resistant elements and the associated cavities are sized so that the end faces 144*a*, 144*b* of the cavities can serve as stops at both ends of the cutting resistant elements. A post tensioning element 155 is used to place the substrate under a compressive load, indicated schematically by arrows 157, producing a compressive strain in the substrate. A compressive stress in the cutting resistant elements can thereby be produced by the substrate acting on the cutting resistant elements 132, which are trapped between the end faces 144*a*, 144*b* of the cavities 138. A need for an additional compressive loading element, such as a spring or an elastomeric element, can thereby be reduced or eliminated. It will be appreciated that, although two cutting resistant elements are illustrated, one, three, or more cutting resistant elements can be used. Similarly, two or more post tensioned members can be used. In some embodiments, the post tensioned substrate can also form all or part of a structural body.

Figure 7:
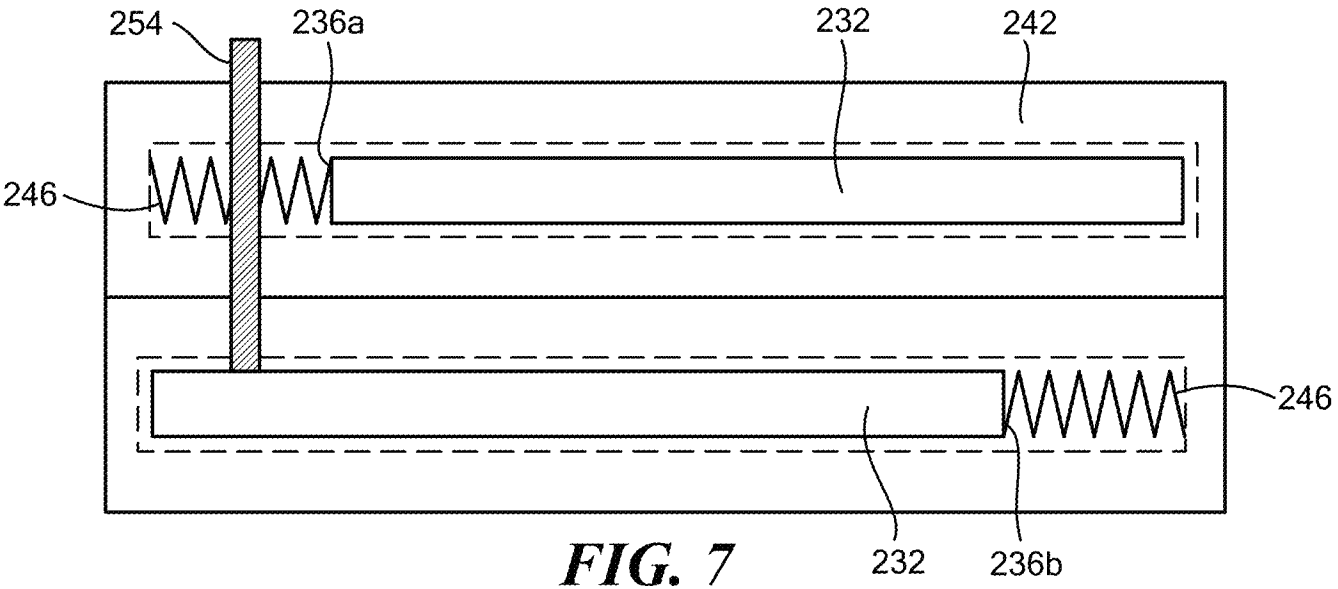
FIG. 7 is a schematic illustration of a still further embodiment of a device incorporating two cutting resistant elements with compressive loading elements in an alternating configuration.

In some embodiments, two cutting resistant elements 232 can be placed in alternating orientations within a substrate 242, such that the compressive loading elements 246 are at opposite end faces 236*a*, 236*b* of the cutting resistant elements, illustrated schematically in FIG. 7. This configuration can reduce or eliminate the potential to undermine the compressive force applied to the cutting resistant element by cutting through a compressive loading element, illustrated by a cutting device 254. In this manner, a greater length of the substrate can be protected.

In some embodiments, the cavity can also be sized to allow the cutting resistant element to spin or rotate within the cavity, for example, if both the cavity and the cutting resistant element have a circular cross section. Spinning of the cutting resistant element can further decrease the effectiveness of a saw blade.

Figure 8:
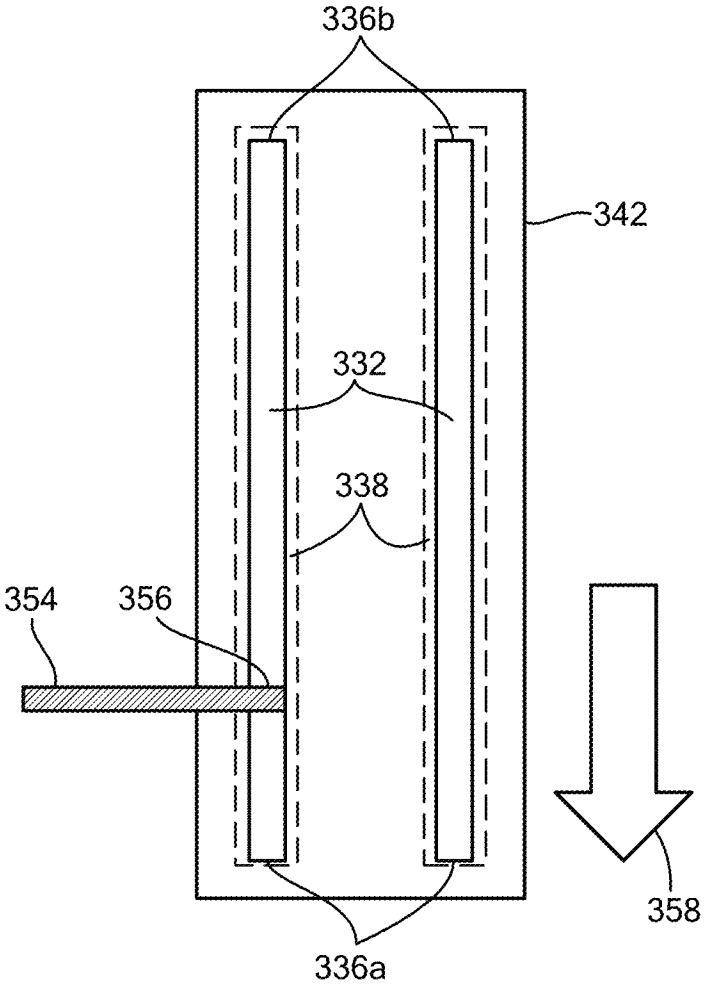
FIG. 8 is a schematic illustration of an embodiment of a device maintaining a cutting resistant element under compression using gravity.

In some embodiments, the cutting resistant element can be oriented vertically such that the force of gravity can be used to produce a compressive force on the cutting resistant element. In one embodiment, the weight of the cutting resistant element provides the compressive loading. See FIG. 8. One or more cutting resistant elements 332 (two are shown) are disposed in a vertical orientation within associated cavities 338 in a substrate 342. The cavities contain the cutting resistant elements and allow them to translate linearly along the axis of its direction of elongation between end faces 336*a*, 336*b*. The substrate 342 supports the weight of the cutting resistant elements at the bottom of each cavity, with the lower end face 336*a* supported on the bottom wall of the cavity. As a cutting device 354, such as a saw blade, cuts through one of the cutting resistant elements, a weight-based clamping force is applied to the saw blade from gravity acting in a downward direction on the cutting resistant element at the cut face 356, indicated schematically by arrow 358.

Figure 9:
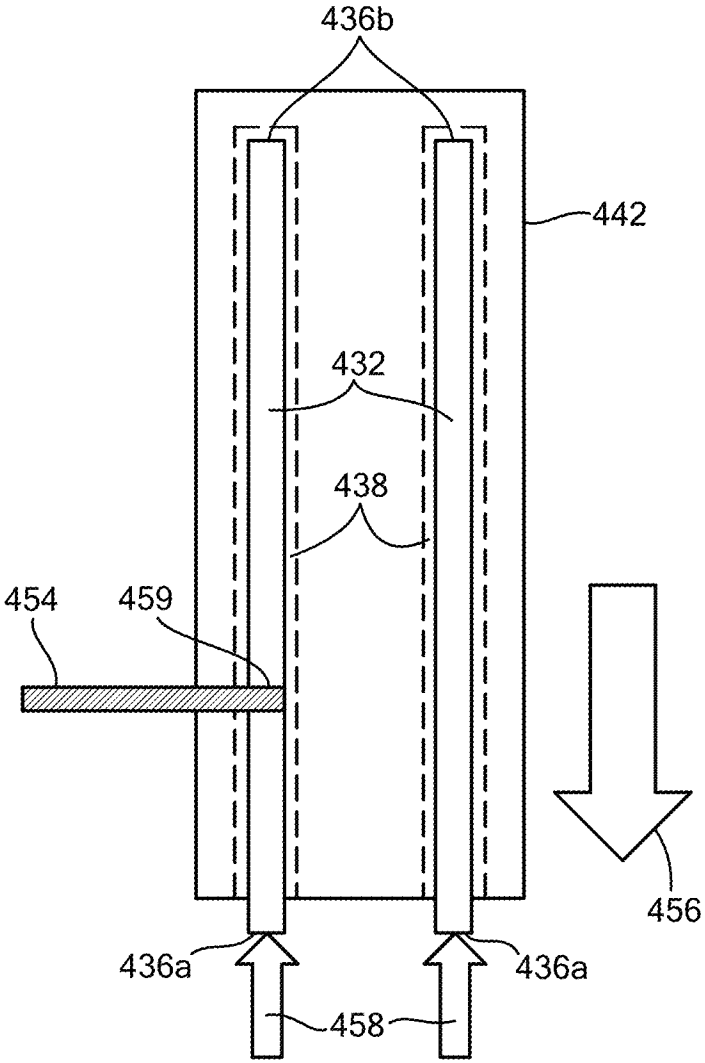
FIG. 9 is a schematic illustration of a further embodiment of a device maintaining a cutting resistant element under compression using gravity.

In a further embodiment, the weight of a structural body itself can be used to provide the compressive force to the cutting resistant element(s), where the support for the structure is carried through the cutting resistant elements. In this configuration, the gravity load of both the structural body and the cutting resistant elements can be applied to the saw blade. Referring to FIG. 9, each cutting resistant element 432 is disposed in a vertical orientation within an associated cavity 438 in the structural body 442, which also serves as a substrate. The cavities contain the cutting resistant elements and allow them to translate linearly along the axis of their direction of elongation. Gravity acts downwardly on the structural body and the cutting resistant elements to create the compressive force, indicated schematically by arrow 456. The cutting resistant elements support the weight of the structural body at the upper faces 436*b* and their own weight is supported by their bottom faces 436*a* resting on a foundation below the structural body, indicated schematically by arrows 458. The cutting resistant element that has been cut by a cutting device such as a saw blade 454 exerts a weight-based clamping force at the cut face 459 on the saw blade.

Figure 10:
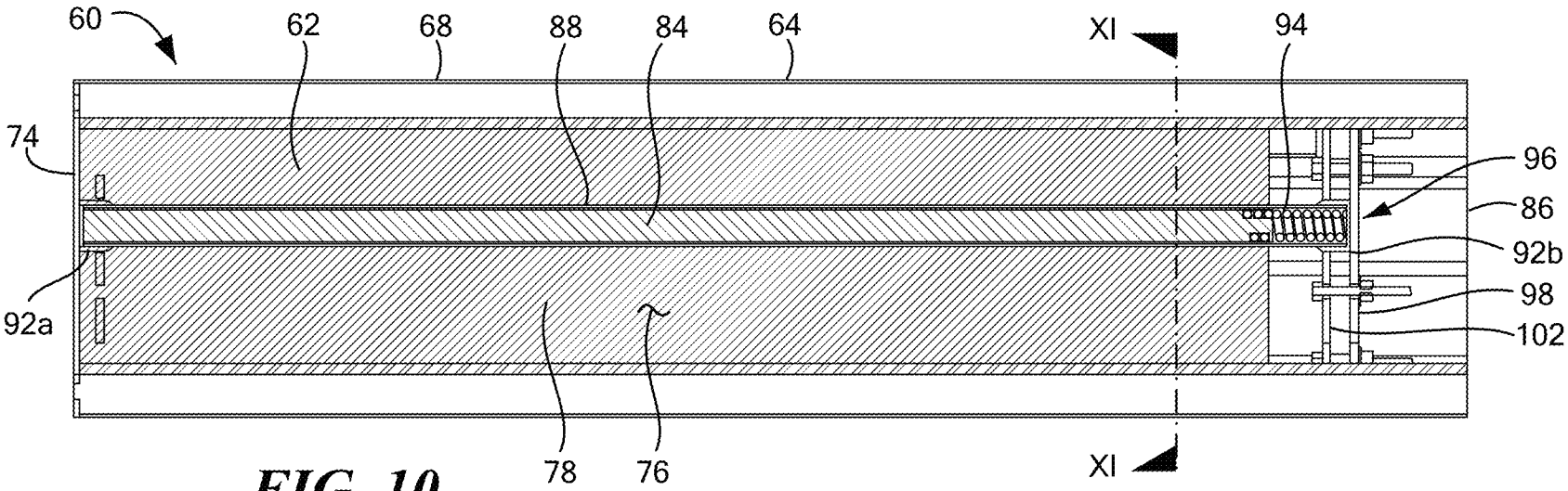
FIG. 10 is a cross-sectional illustration of an embodiment of a device to provide protection against cutting from a saw blade.
Figure 11:
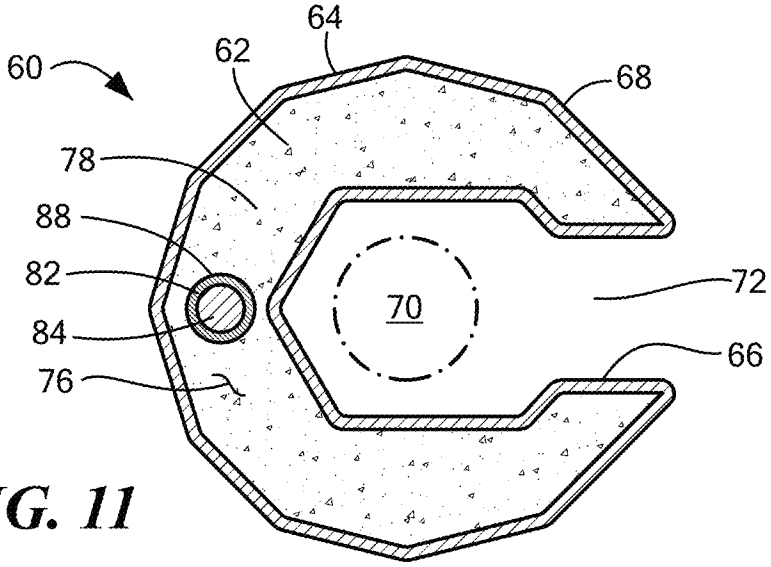
FIG. 11 is a cross-sectional view of the device of FIG. 10 along line IX-IX.

FIGS. 10 and 11 illustrate a further embodiment of a device 60 for protecting a structural element from cutting with a saw blade. The device includes a substrate 62 including a shell 64 of a material such as steel or another metal encasing a filling material 78, such as concrete in the interior region 76. In the embodiment shown, the substrate is configured to surround a structural element 70 such as a bridge suspension cable. The shell 64 is formed as an inner shield 66 and an outer shield 68. An opening 72 through the substrate where the inner and outer shields meet allows the device to be placed around the cable. The shell 64 includes an end wall 74 across one end. A cavity 82 is provided in the filler material for a cutting resistant element 84. The cavity 82 can be lined with a cartridge tube 88. The opposite end 86 of the shell 64 is open and accessible to allow installation and compressive loading of the cutting resistant element 84.

The cutting resistant element 84 can be a rod sealed under compression within the cartridge tube of the cavity 82. The cartridge tube can be closed with end caps 92*a*, 92*b* on opposite ends. The cartridge tube and the rod can be formed from a material such as steel or another metal such as aluminum or an aluminum alloy. A compressive loading element 94 can include a compression spring or springs that fit within a space at one end of the cartridge tube. In the embodiment shown, the rod includes an annular external recess about one end to provide a seat for the spring. A closure fixture 96 is provided within the shell 64 near the open end 86 to compress the spring or springs. In the embodiment shown, the closure fixture includes a push plate 98 that pushes the cap 92*b* over the cartridge tube sufficiently to compress the spring. The push plate can be fixed into place, for example with one or more bolt and nut assemblies that extend from a fixed plate 102. It will be appreciated that other mechanisms or fixtures to maintain the compressive loading on the cutting resistant element within the cavity can be used.

Similarly, other configurations for the substrate can be used. For example, in some embodiments, the substrate can be formed as two or more parts joined together. The parts can be fixedly joined or can be movably joined, as with a hinge mechanism to allow the substrate to be placed around a structural element such as a cable. It will be appreciated that the device can be fixed around the cable in any suitable manner. For example, in some embodiments, the device can be incorporated into an existing cable protection system, such as the cable protection system shown in U.S. Pat. No. 8,769,882. In some embodiments, the device can be incorporated into a load-bearing element of a structure or can form an element of a bridge cable or a structural column.

Figure 12:
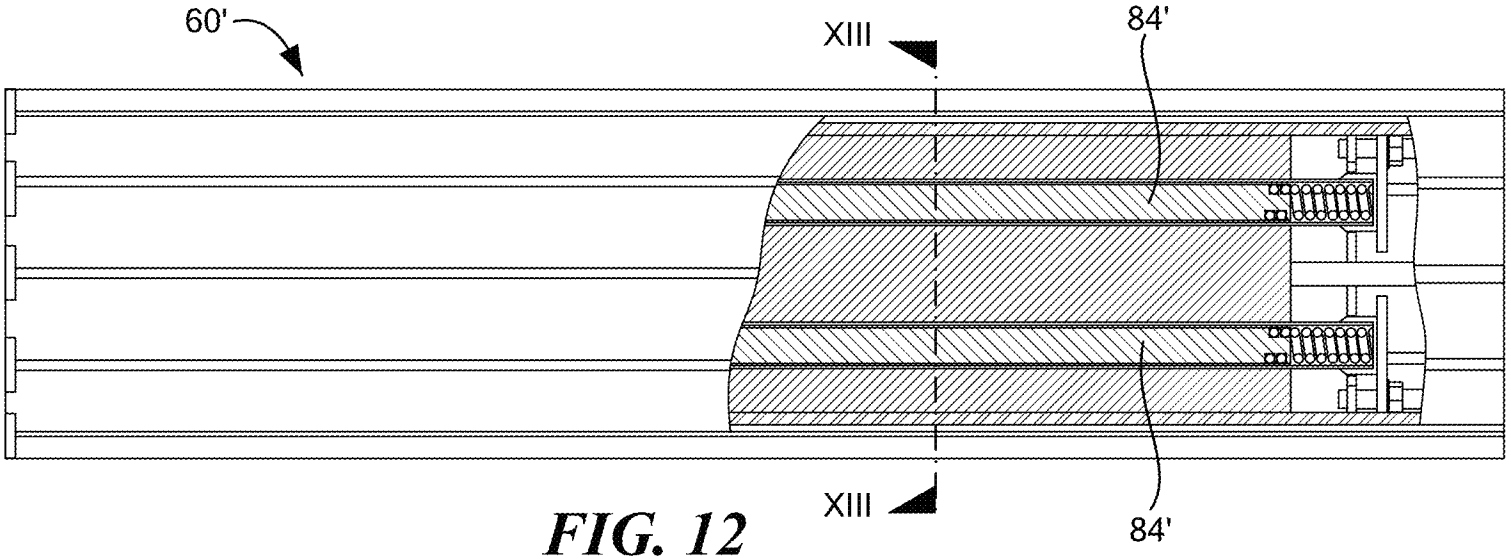
FIG. 12 is a partial cross-sectional illustration of a further embodiment of a device to provide protection against cutting from a saw blade.
Figure 13:
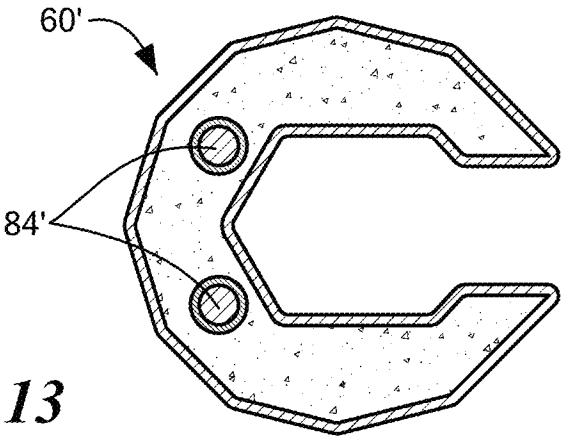
FIG. 13 is a cross-sectional view of the device of FIG. 12 along line XI-XI.

More than one cutting resistant element can be provided within the substrate. FIGS. 12 and 13 illustrate an embodiment of a device 60' in which two cutting resistant elements 84' are provided.

Figure 14:
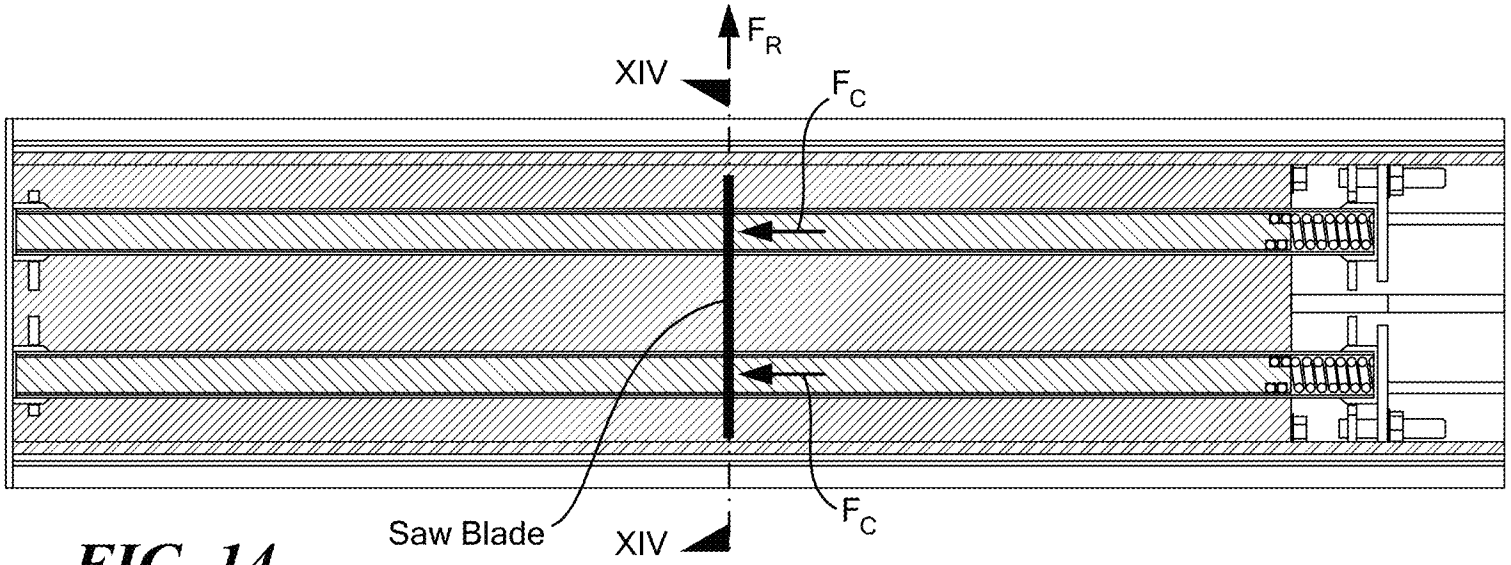
FIG. 14 is a cross-sectional illustration of the device of FIG. 10 being cut by a saw blade.
Figure 15:
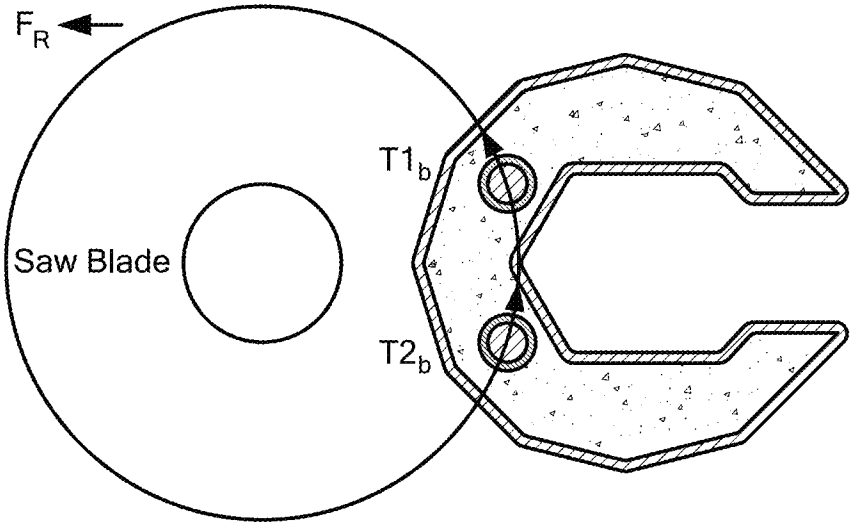
FIG. 15 is a cross-sectional view of the device of FIG. 14 along line XIII-XIII.

Referring to FIGS. 14 and 15, the saw blade removal force $F_R$, which is the force required to pull the saw blade from the clamping action of the cutting resistant element, can be estimated using a simple coefficient of friction (COF) model, where $\mu_{COF}$ is the coefficient of friction between the materials of the saw blade and cutting resistant element, and $F_C$ is the clamping force provided, for example, by a spring normal to the blade surface.

$$F_R=\mu_{COF}F_C$$

Braking torque, $T_b$, applied to the cutting blade is dependent on the effective radius, r, of the blade at the point of clamping and the blade removal force.

$$T_b=rF_R$$

The greater the coefficient of friction of the cutting resistant element, the more efficient the cutting resistant element is at slowing and stopping the saw blade.

Depending on the materials involved, the clamping force can be up 10,000 pounds (or more), which can provide adequate resistance through the blade removal force $F_R$. In general, larger threats require larger clamping forces to be effective.

At a blade removal force of about 100 pounds, for example, if a cutting device operator were to continue trying to cut the system, the required power to run against such a resistance would be beyond the capability of many saws. For example, a 12-inch diameter saw operating at 2000 rpm, with a blade removal force of 100 pounds would require about 20 horsepower to run, which is far beyond the capability of typical hand held saws.

The configuration and material of the cutting resistant element can be selected to maximize the friction force and braking torque within the constraints of the particular application. By way of example, Table 1 lists coefficients of friction between different materials that can be used in some embodiments of the device.

TABLE 1

| Materials | Static Coefficient of Friction, $\mu_s$ | Kinetic Coefficient of Friction, $\mu_k$ |
|---|---|---|
| Steel - Steel | 0.8 | .42-.57 |
| Diamond - Metal | 0.1-0.15 | |

In some embodiments, the cutting resistant elements can be hardened, for example, by annealing. In some embodiments, the cutting resistant elements can be hardened to a Rockwell hardness of at least C25 or of at least C60. Additional hardening can be useful to delay the cutting time. However, once the cutting resistant element is cut, the spring-loading turns into a friction clamp and physically stops the blade. Coefficient of friction is generally more effective than hardness for stopping the blade. Hardness can be important in cases where delaying the cutting time or activation time of the spring-loaded clamping effect is deemed beneficial.

Figure 16:
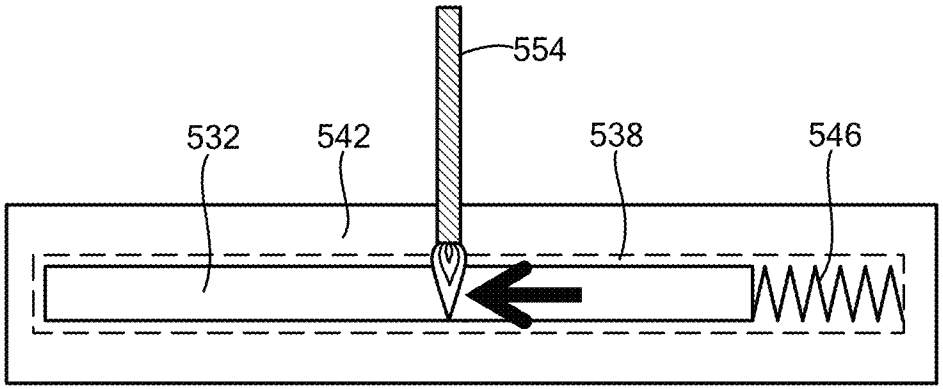
FIG. 16 is a schematic illustration of an embodiment of a device to stop a thermal cutting device.

In some embodiments, a device to protect against cutting from a thermal cutting device (TCD) can be provided. Referring to FIG. 16, in some embodiments, the device can have a configuration similar to the device described above with respect to FIG. 4. In particular, a cutting resistant element 532 can be loaded axially in a cavity 538 in a substrate 542 with a compressive loading element 546. Under the compressive loading, the cutting resistant element can continue to feed material of the cutting resistant element into the cutting region of a thermal cutting device 554, thus impeding the advancement of the TCD. In some embodiments, the cutting resistant element 532 can be a rod, which can be loaded with one or more springs. In some embodiments, a plurality of rods in associated cavities can also be used. Since the cutting resistant element is being pushed into the cutting region, supplying new material to be cut, and thus supporting the resistive action, the material of the cutting resistant element does not need to melt above the operating temperature of the TCD in the cutting region. In some embodiments, materials for the cutting resistant elements can include, without limitation, steel, concrete, tungsten, carbon fiber composite material, and fiberglass composite material. Carbon fiber composite rods are particularly suited to this application, because the carbon fiber does not have a melting point, but rather sublimes at a temperature of greater than 3600° C.

In some embodiments, in addition to resisting the high temperature environment of the TCD, a TCD cutting resistant element can react with oxygen being provided to the TCD, and can burn vigorously enough to eject a plume of hot combustion products out the hole being cut (termed blow-back), and directed at the operator of the TCD, thus providing a direct deterrent to cutting with a TCD. Any material that can burn vigorously is a candidate for the reactive TCD cutting resistant element, including, without limitation, asphalt, steel, magnesium, and aluminum.

Figure 17:
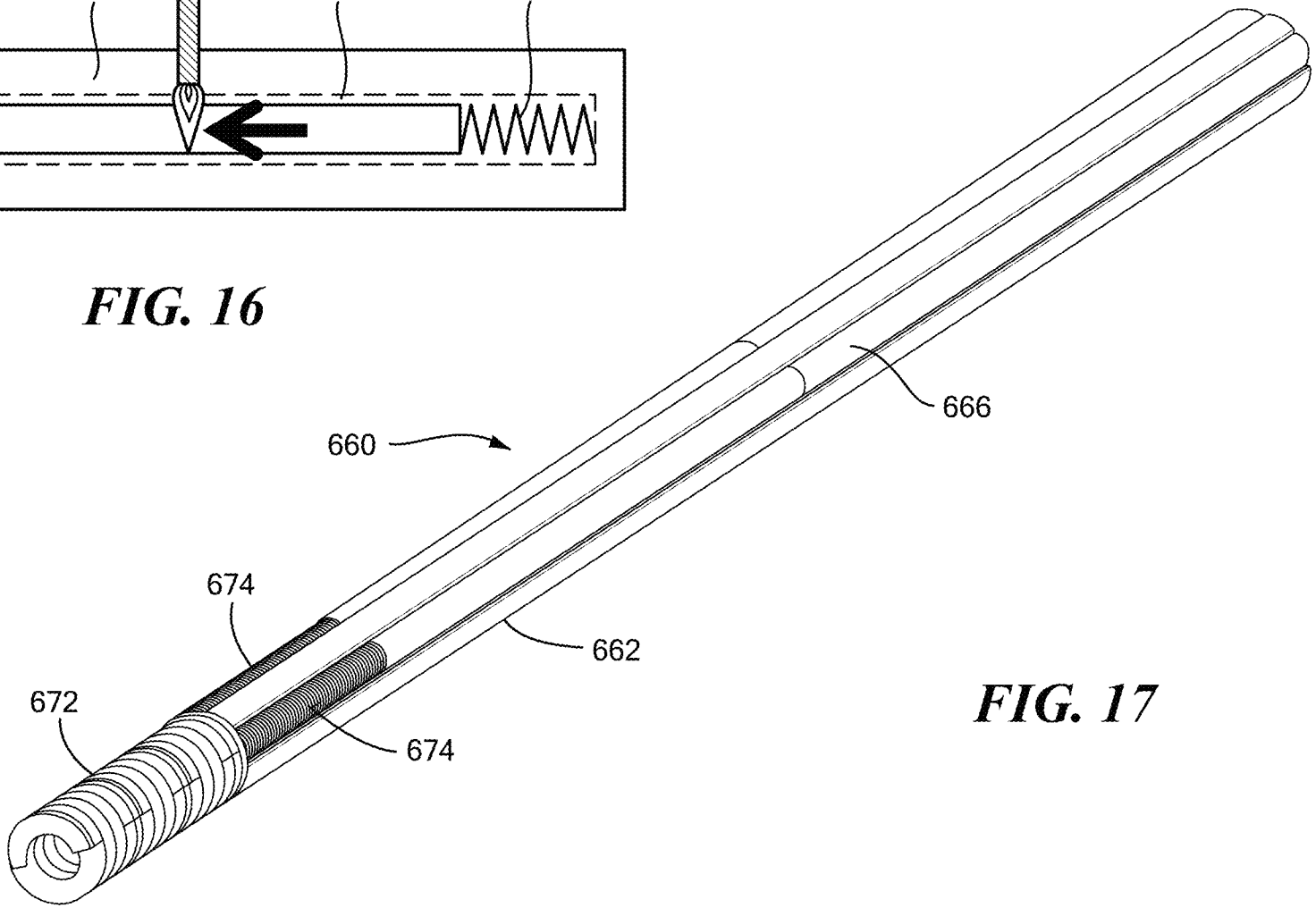
FIG. 17 is a schematic illustration of a further embodiment of a device to stop a thermal cutting device.
Figure 18:
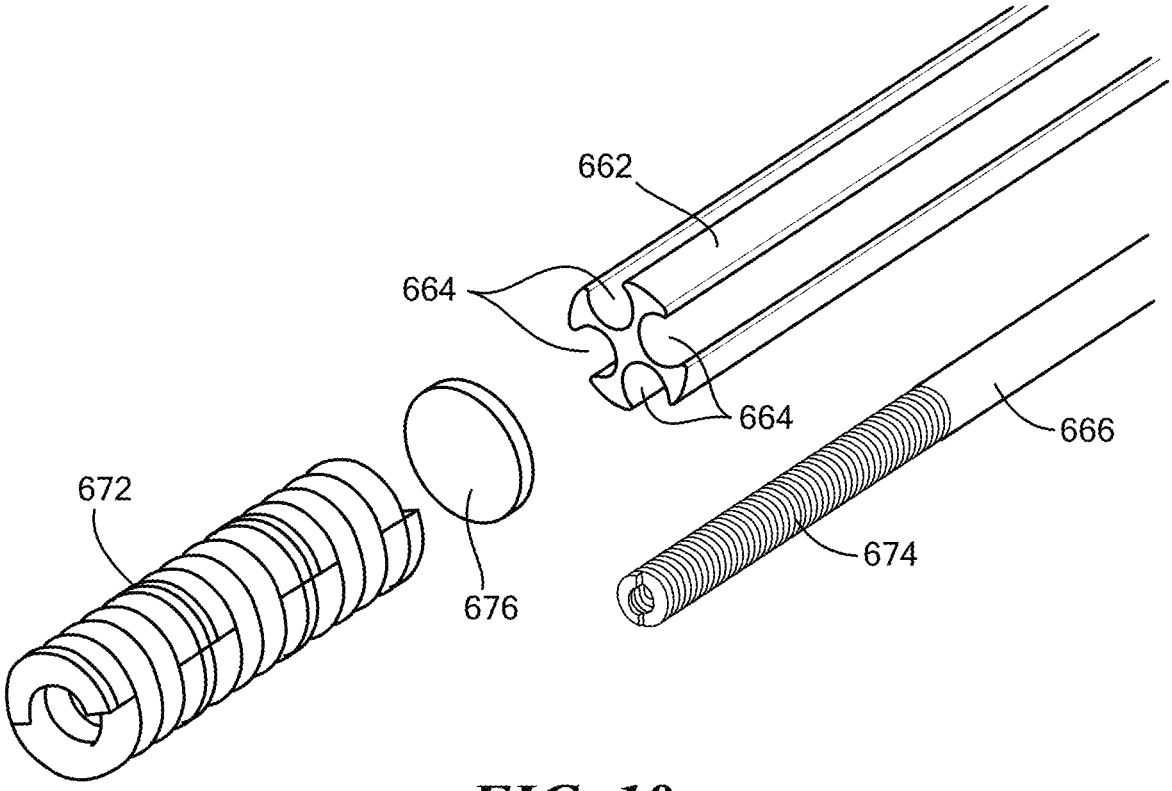
FIG. 18 is an exploded view of the device of FIG. 17.
Figure 19:
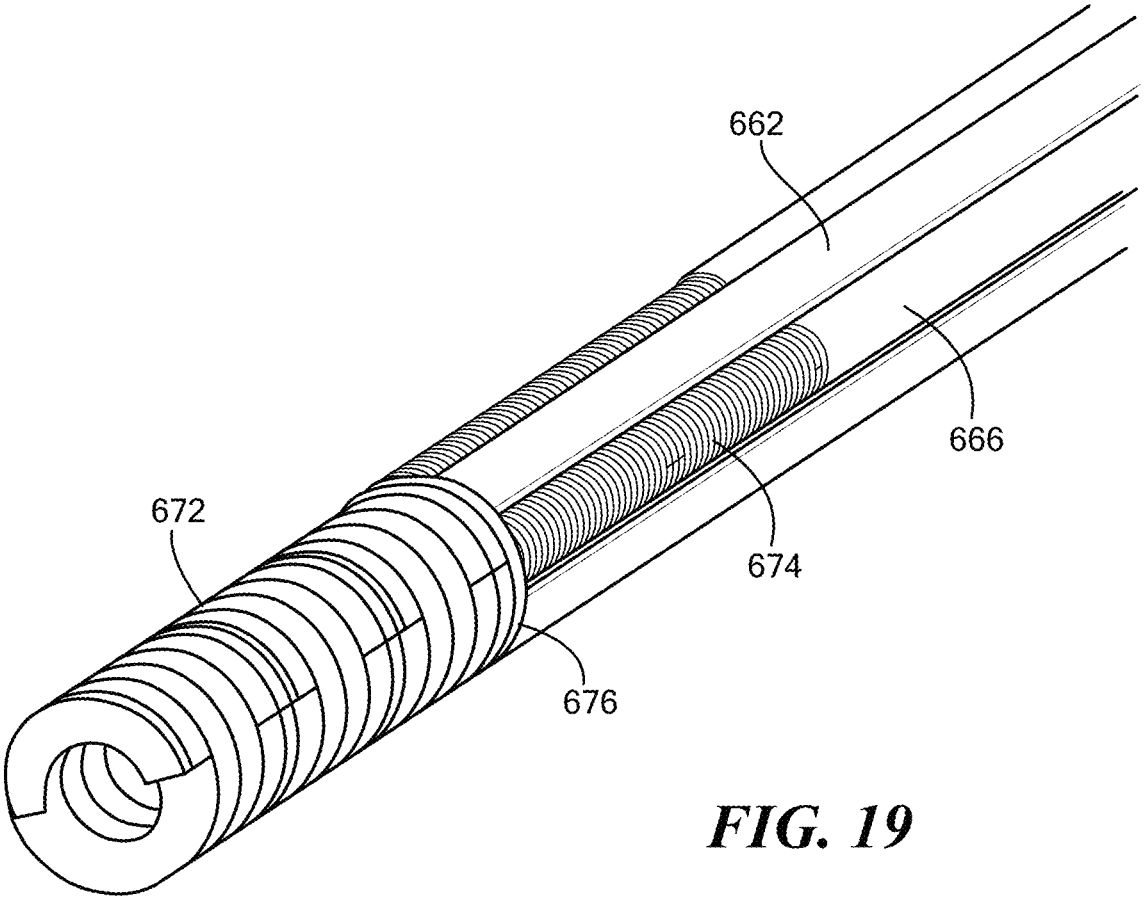
FIG. 19 is a partial end view of the device of FIG. 17.

In some embodiments, a device that can resist cutting from both a saw blade and a thermal cutting device can be provided, termed a dual defeat device. FIGS. 17-19 illustrate an embodiment of a dual defeat device. An elongated cutting resistant element 660 can include a blade stopping member 662 such as an elongated rod of a material, such as aluminum, to grip or stop a saw blade, as described above. In addition, one or more channels 664 can be provided along the length of the rod. The cutting resistant element 660 can also include a thermal resistant member 666, such as a carbon fiber rod, disposed within each of the channels 664. Four channels and thermal resistant members are shown; however, any desired number can be provided. The cutting resistant element 660 can be disposed within a substrate (not shown) as described above. A compressive element 672, such as one or more springs, can be used to load the blade stopping member 662, as described above. An additional compressive element 674 can include one or more additional springs to load each of the thermal resistant members 666 in their associated channels 664. A loading disk 676 can be located between the compressive element 672 and an end face of the blade stopping member 662. The loading disk can apply a load from the springs 672 to the blade stopping member 662. The loading disk can also serve as a stop for the springs 674 within the channels 664.

In some embodiments, a dual defeat device can have other configurations. For example, the blade stopping member and the thermal resistant member can be arranged side by side or can have an elongated nested configuration.

In some embodiments, a device to protect a structural element from cutting can include a passive cutting resistant element that does not need to be maintained under compression. The cutting resistant element can be maintained in an unstressed state within a cavity in a substrate. When the cutting device includes a cutting blade or saw blade, portions of the cutting resistant element can be pulled out of the cavity by the saw blade into a region in the substrate cut by the saw blade to exert frictional forces on surfaces of the saw blade to slow or stop the blade.

Figure 20:
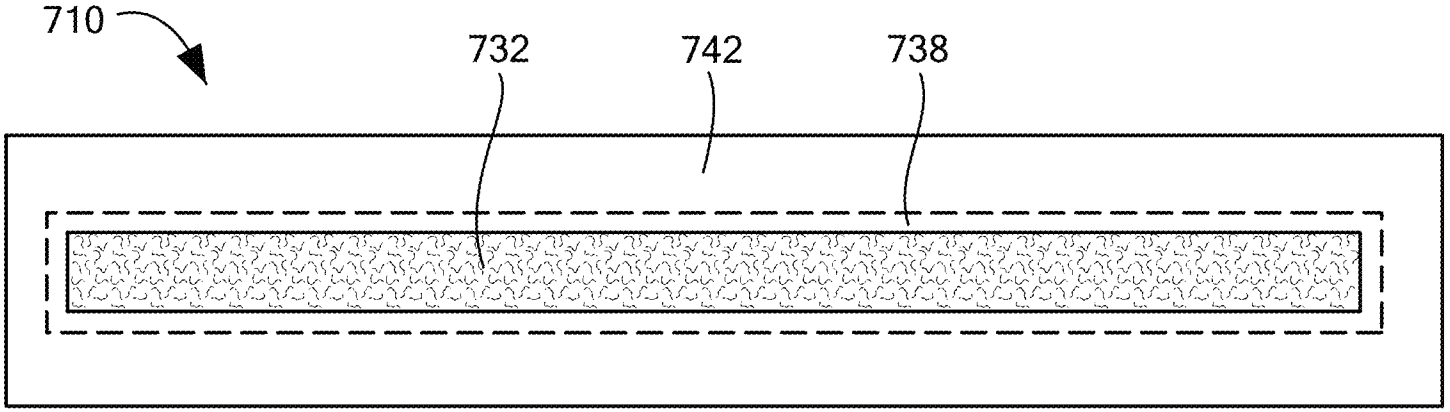
FIG. 20 is a schematic illustration of an embodiment of a device incorporating a passive cutting resistant element.

Referring more particularly to FIG. 20, a device 710 can include a cutting resistant element 732 disposed within a cavity 738 in a substrate 742. The cutting resistant element 732 within the cavity 738 is passive, i.e., not under compression; the cutting resistant element relies on an unstressed state to provide resistance to the cutting blade. The substrate 742 can be formed of any suitable material, such as concrete, a metal or metal alloy, or a reinforced composite material. The cavity 738 can conform to the shape of the cutting resistant element 732 to contain and protect the cutting resistant element. In the embodiment shown, the cutting resistant element and the cavity are generally elongated, although any shapes can be used, as determined by the structural application.

Figure 21:
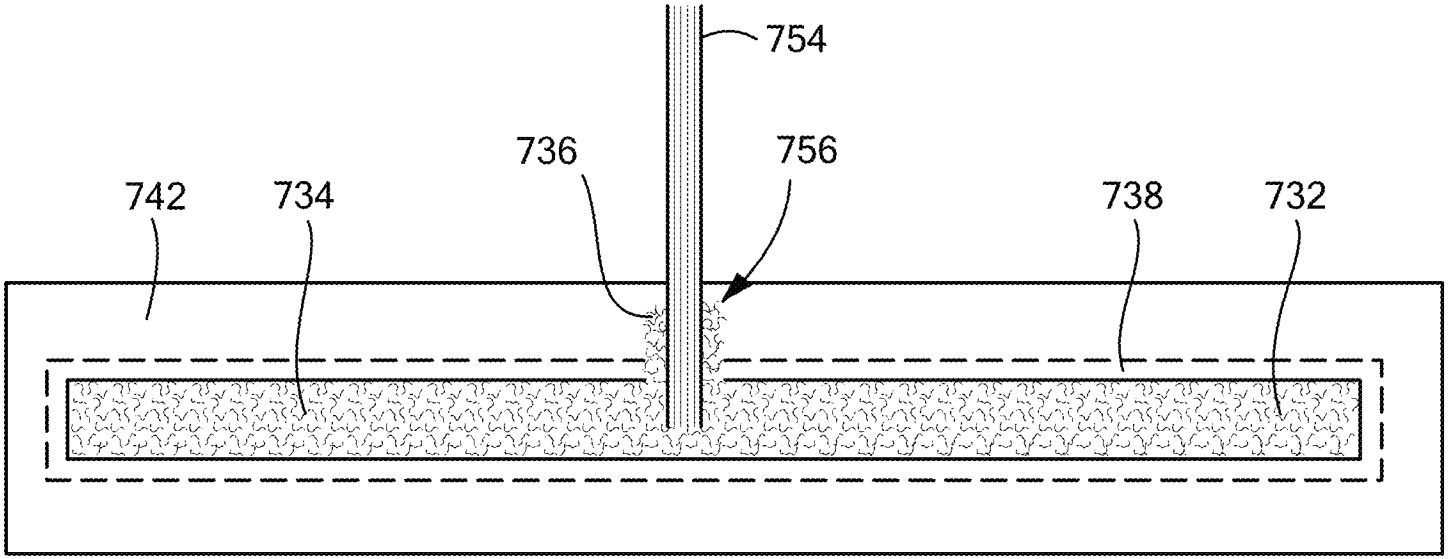
FIG. 21 is a schematic illustration of the embodiment of FIG. 20 showing the cutting resistant element frictionally engaging a saw blade.

In some embodiments, the cutting resistant element can be formed from a fibrous material. Referring to FIG. 21, a cutting blade 754 has cut through the substrate 742 and into the fibers of a fibrous material 734 forming the cutting resistant element 732 in the cavity. Some of the fibers 736 tend to get caught by the blade 754 and pulled out of the substrate cavity 738 into a region 756 in the substrate cut by the blade. In this region, the fibers interact with a non-cutting portion of the blade, tending to create friction on the surfaces of the blade to slow or stop it.

In some embodiments, the cutting resistant element can be formed from a fibrous material such as ultra-high molecular weight polyethylene (UHMW) fibers, aramid fibers, carbon fibers, or other high strength fibers in a dry state. High tenacity fibers such as ultra-high molecular weight polyethylene or UHMW fibers, commercially available as DYNEEMA®, or aramid fibers, commercially available as KEVLAR®, are suitable because of their high toughness, which helps the fibers to be pulled into the blade cavity without or prior to being cut by the blade.

In some embodiments, a combination or hybrid of aramid and UHMW fibers can be used, because the UHMW fibers have better toughness, tending to be more easily pulled into the blade cavity and pulling the aramid fibers along, while the higher temperature resistance of the aramid fibers can help survival (i.e., by not melting) in the potentially hot blade cavity region. In some embodiments, multiple tows of unidirectional UHMW fibers and aramid fibers, covered and held together by a fiber braid on the outside, can be used. In some embodiments, carbon fiber can be used as a component of a hybrid or combination of fibers, due to the ultrahigh temperature resistance of carbon fibers, which do not melt, but sublime at temperatures greater than 3600° C. Relatively tough varieties of carbon fiber are commercially available, such as IM7 from Hexcel Corporation.

In some embodiments, the fibers can be formed into a rope or bundle. Fiber ropes can be twisted, braided, or unidirectional, or a combination thereof. In some embodiments, a rope can have a braided exterior and a unidirectional collimated interior.

In some embodiments, the cutting resistant element can be formed from a solid material, such as a rubber or other elastomeric material. In some embodiments, the cutting resistant element can be a solid material with viscoelastic properties. In some embodiments, the cutting resistant element can be a combination of fibers and a solid material formed into a composite material.

The device can be disposed to protect a structural member of a structure. In some embodiments, the structural member to be protected can bear one or more of a compressive load, a tensile load, or a bending load. In some embodiments, the structural member can be, for example and without limitation, a beam, a column, a post, a pier, a cable, a catenary, a truss, a strut, a brace, a plate, a shell, or an arch.

In some embodiments, the device can be integrated into or can comprise a load-bearing member of a structure. In some embodiments, the substrate can comprise a component of a bridge cable or a structural column. In some embodiments, the substrate can be configured to surround at least a portion of a periphery of a structural member, such as a cable, a structural column, a structural beam, or a truss member.

In some embodiments, the cutting resistant element can comprise a load bearing member of a structure. In some embodiments, the cutting resistant element can form a beam, a column, or the like. In some embodiments, the cutting resistant element can be oriented vertically as a column, pier, post, or the like. In some embodiments, in a vertical orientation, the weight of the cutting resistant element can provide the compressive loading.

It will be appreciated that the device can be used in a variety of applications in which protection against cutting is useful. For example, in some embodiments, the device can form or be incorporated into a security device to provide protection against cutting, such as, without limitation, a safe, a security door, or a bicycle lock.

The device can be sized and configured in any manner depending on the structural member to be protected. In some embodiments, the device can include a first cutting resistant element in a first cavity for resisting a cutting threat from a saw blade, and a second cutting resistant element in a second cavity for resistant a cutting threat from a thermal cutting device.

In some embodiments, a method for protecting a structural member of a structure can be provided, in which the device is disposed in a position to protect a structural member that bears a tensile load, a compressive load, or a bending load.

Example

An embodiment of a protective device as shown in FIGS. 12 and 13 was assembled and tested. Two cutting resistant elements each included a rod of 4140 alloy steel (chrome-moly). The outer diameter of each rod was 1.0 inch. The rods were annealed to a Rockwell hardness of C25. The inner diameter of each tube of the cavities was 1.15 inch.

For the compressive loading element for each rod, two springs were used, each having a spring rate of 1,600 lbs/inch. The two springs were stacked in series and compressed to gain 0.75 inches of stroke for each spring-loaded steel rod. This improved the robustness of the load setting window and increased the number of cuts that could be made before all spring pressure was removed due to removal of the material of the rods with each cut.

Two coil springs stacked on top of each other were considered to be springs in series. Properties for the springs used in the test assembly are shown in Table. 2.

TABLE 2

| SPRING RATE | FREE LENGTH | OD | ID | WIRE HT | WIRE WIDTH | MAX DEFLECTION | REFERENCE |
|---|---|---|---|---|---|---|---|
| 1,600 lbs/in | 1.5 in | 1 in | .5 in | .195 in | .216 in | 25% | McMASTER CARR 9595K39 |

Using the following equation, the equivalent spring rate for two springs stacked in series was determined to be 800 lbs/in.

$$\frac{1}{k_{eq}} = \frac{1}{k_1} + \frac{1}{k_2}$$

The test used a Stihl TS 510 AV saw with a diamond blade to cut into the protective device. The saw blade jammed on the first cut with enough clamping force that the user could not free the saw blade by pulling and yanking. On the first cut, the user needed to use a pry bar to free the jammed saw blade. The saw blade jammed in the first rod 12 times and had to be unjammed and restarted. The spring rate of 800 lb/in and a compression stroke of 0.75" resulted in a compressive force of 600 pounds in the rods. Given the steel-on-steel coefficient of friction of 0.8, the static resistance to blade removal was 480 pounds. This indicates that the operator would need to pull with a force of 480 pounds to begin to free the blade, which was evidenced by the need to use a pry bar to free the blade.

After the $12^{th}$ jam, the second rod was fully cut and activated. The first rod was fully cut and engaged and locked the blade before the second rod was activated. The second rod jammed the blade twice before the test was stopped. The saw blade penetrated less than 1.044" into the inner shield, which was not far enough to reach the cable. The test was stopped with accumulated cutting time of approximately 1.5 hours, well beyond the expected response time of 5 to 30 minutes. The second rod still had significant spring stroke remaining.

Other aspects include the following:

1. A device to provide protection against a cutting threat, comprising:

a substrate, a cavity disposed within the substrate; and a cutting resistant element disposed within the cavity to exert compressive forces or frictional forces on a cutting device to slow or stop the cutting device when the cutting device cuts into the cutting resistant element, thereby impeding further cutting by the cutting device into the cutting resistant element.

2. The device of embodiment 1, wherein:

the cavity within the substrate extends along an axis; and the cutting resistant element is disposed to translate along the axis within the cavity and is maintained under compression within the cavity by the compressive forces extending along the axis, wherein when a cutting device cuts into the cutting resistant element, the compressive forces push opposed cut surfaces of the cutting resistant element into the cutting device, thereby impeding further cutting by the cutting device into the cutting resistant element.

3. The device of any of embodiments 1-2, wherein when the cutting device is a saw blade, the cutting resistant element exerts a compressive stress on opposed surfaces of the saw blade cutting into the cutting resistant element.

4. The device of embodiment 3, wherein the compressive stresses exerted on the opposed surfaces of the saw blade are sufficient to clamp the saw blade.

5. The device of any of embodiments 3-4, wherein the cut surfaces of the cutting resistant element under compression exert a braking torque on the opposed surfaces of the saw blade.

6. The device of any of embodiments 3-5, wherein the cut surfaces of the cutting resistant element under compression exert a frictional force sufficient to slow or stop the saw blade.

7. The device of any of embodiments 3-6, wherein the cut surfaces of the cutting resistant element under compression exert a frictional force sufficient to jam the saw blade between the cut surfaces.

8. The device of any of embodiments 3-7, further comprising a second cavity disposed within the substrate, and a second cutting resistant element disposed within and maintained under compression within the second cavity to exert a compressive force to feed material of the second cutting resistant element at opposed cut surfaces into a cutting region of a thermal cutting device.

9. The device of any of embodiments 1-8, wherein when the cutting device is a thermal cutting device, the cutting resistant element exerts a compressive force to feed material of the cutting resistant element at the opposed cut surfaces into a cutting region of the thermal cutting device.

10. The device of any of embodiments 1-9, wherein:

the cutting resistant element is maintained in an unstressed state within the cavity, and;

when the cutting device is a saw blade, portions of the cutting resistant element are disposed to be pulled by the saw blade into a region cut by the saw blade to exert frictional forces on surfaces of the saw blade.

11. The device of embodiment 10, wherein the region cut by the saw blade is in the substrate outside of the cavity.

12. The device of any of embodiments 1-11, wherein the cutting resistant element is formed of a metal or metal alloy, concrete, asphalt, a fiber-reinforced composite material, a fibrous material, an elastomeric material, a viscoelastic material, an oxygen-reactive material, or a combination thereof.

13. The device of any of embodiments 1-12, wherein the cutting resistant element is formed of steel or aluminum or an aluminum alloy.

14. The device of any of embodiments 1-13, wherein the cutting resistant element is formed of steel, tungsten, magnesium, aluminum, a carbon fiber composite material, or a fiberglass composite material, concrete, or asphalt.

15. The device of any of embodiments 1-14, wherein the cutting resistant element is formed of an oxygen-reactive material.

16. The device of any of embodiments 1-15, wherein the cutting resistant element is formed of a dry fibrous material.

17. The device of embodiment 16, wherein the dry fibrous material is an ultrahigh molecular weight polyethylene fiber material, an aramid fiber material, a carbon fiber material, or a combination thereof.

18. The device of any of embodiments 1-17, wherein the cutting resistant element is formed of an elastic or viscoelastic solid material.

19. The device of any of embodiments 1-18, wherein the cutting resistant element is formed of a combination of a dry fibrous material and an elastic or viscoelastic solid material.

20. The device of any of embodiments 1-19, wherein the cutting resistant element comprises a bar or rod.

21. The device of any of embodiments 1-20, further comprising a compressive loading element disposed to maintain the cutting resistant element under compression within the cavity.

22. The device of embodiment 21, wherein the compressive loading element comprises at least one spring under compression disposed at one end of the cutting resistant element and a stop disposed at an opposite end of the cutting resistant element.

23. The device of any of embodiments 21-22, wherein the compressive loading element comprises stops disposed at opposite ends of the cavity.

24. The device of any of embodiments 21-23, wherein the compressive loading element comprises at least one stop at one end of the cavity, wherein the at least one stop is detachable to allow the cutting resistant element to be loaded into the cavity and attachable to maintain the cutting resistant element under compression within the cavity.

25. The device of any of embodiments 21-24, wherein the compressive loading element comprises post tensioned members within the substrate.

26. The device of any of embodiments 21-25, wherein the cavity extends along a vertically oriented axis, and the compressive loading element comprises a weight of the cutting resistant element bearing on a bottom surface of the cavity.

27. The device of any of embodiments 21-26, wherein the cavity extends along a vertically oriented axis, and the compressive loading element comprises a weight of the substrate bearing on an upper end of the cutting resistant element.

28. The device of embodiment 27, wherein the compressive loading element further comprises a lower end of the cutting resistant element bearing on a foundation below a lower open end of the cavity.

29. The device of any of embodiments 1-28, further comprising a second cutting resistant element maintained under compression within a second cavity in the substrate by a further compressive force extending generally parallel to the cavity.

30. The device of embodiment 29, further comprising:

a first compressive loading element disposed to maintain the cutting resistant element under compression within the cavity; and a second compressive loading element disposed to maintain the second cutting resistant element under compression within the second cavity;

wherein the first compressive loading element is disposed at one end of the cutting resistant element, and the second compressive loading element is disposed at a second end of the second cutting resistant element opposite the one end of the cutting resistant element.

31. The device of any of embodiments 1-30, wherein the cutting resistant element comprises a blade stopping member configured to exert a compressive stress on opposed surfaces of a saw blade cutting into the blade stopping member, and a thermal resistant member configured to feed material under compression to a thermal cutting device.

32. The device of embodiment 31, wherein the blade stopping member comprises an elongated element, a channel is formed along a surface of the elongated element, and the thermal resistant member is disposed in the channel.

33. The device of embodiment 32 further comprising a first compressive loading element disposed to maintain the blade stopping member under compression within the cavity and a second compressive loading element disposed to maintain the thermal resistant member under compression in the channel.

34. The device of any of embodiments 1-33, wherein the cavity is lined with a tube, and the cutting resistant element is disposed within the tube.

35. The device of any of embodiments 1-34, wherein the cutting resistant element is disposed for spinning motion about an axis within the cavity.

36. The device of any of embodiments 1-35, wherein the substrate comprises concrete, a metal or metal alloy, or a reinforced composite material.

37. The device of any of embodiments 1-36, wherein the substrate comprises a metal shell having an interior region, the interior region filled with concrete.

38. The device of any of embodiments 1-37, wherein the substrate comprises an element of a bridge cable or a structural column.

39. The device of any of embodiments 1-38, wherein the substrate is configured to surround at least a portion of a periphery of a structural member, the structural member comprising a cable, a structural column, a structural beam, or a truss member.

40. The device of any of embodiments 1-39, wherein the substrate comprises a load bearing member of a structure.

41. The device of any of embodiments 1-40, wherein the cutting resistant element comprises a load bearing member of a structure.

42. The device of any of embodiments 1-41, wherein the cutting resistant element is disposed vertically within a structure.

43. The device of any of embodiments 1-42, wherein the device comprises at least a portion of a security device.

44. The device of embodiment 43, wherein the security device is a safe, a security door, or a bicycle lock.

45. A structure comprising:

a structural member that bears one or more of a compressive load, a tensile load, or a bending load; and the device of any of embodiments 1-44 disposed to protect the structural member.

46. A method for protecting a structure against a cutting threat, comprising:

providing the device of any of embodiments 1-44;

disposing the device in a position to protect a structural member of the structure that bears a compressive load, a tensile, load, or a bending load.

As used herein, "consisting essentially of" allows the inclusion of materials or steps that do not materially affect the basic and novel characteristics of the claim. Any recitation herein of the term "comprising," particularly in a description of components of a composition or in a description of elements of a device, can be exchanged with "consisting essentially of" or "consisting of."

It will be appreciated that the various features of the embodiments described herein can be combined in a variety of ways. For example, a feature described in conjunction with one embodiment may be included in another embodiment even if not explicitly described in conjunction with that embodiment.

To the extent that the appended claims have been drafted without multiple dependencies, this has been done only to accommodate formal requirements in jurisdictions which do not allow such multiple dependencies. It should be noted that all possible combinations of features which would be implied by rendering the claims multiply dependent are explicitly envisaged and should be considered part of the invention.

The present invention has been described in conjunction with certain preferred embodiments. It is to be understood that the invention is not limited to the exact details of construction, operation, exact materials or embodiments shown and described, and that various modifications, substitutions of equivalents, alterations to the compositions, and other changes to the embodiments disclosed herein will be apparent to one of skill in the art.

What is claimed is:

1. A device to provide protection against a cutting threat, comprising:

a substrate, a cavity disposed within the substrate, the cavity having a longest dimension comprising a length extending along an axis of elongation from a first end to a second end of the cavity;

a cutting resistant element comprising an elongated member having opposed end faces, the cutting resistant element disposed within the cavity to translate along the axis of elongation to exert compressive forces or frictional forces on a cutting device to slow or stop the cutting device when the cutting device cuts into the cutting resistant element, thereby impeding further cutting by the cutting device into the cutting resistant element; and a compressive loading element disposed to maintain the cutting resistant element under compression and translatable along the axis of elongation within the cavity by exerting a compressive force or stress on the opposed end faces of the cutting resistant element, the compressive loading element comprising at least a spring or an elastic element disposed at the first end or the second end of the cavity.

2. The device of claim 1, wherein when a cutting device cuts into the cutting resistant element, the compressive forces push opposed cut surfaces of the cutting resistant element into the cutting device, thereby impeding further cutting by the cutting device into the cutting resistant element.

3. The device of claim 1, wherein when the cutting device is a saw blade, the cutting resistant element exerts a compressive stress on opposed surfaces of the saw blade cutting into the cutting resistant element.

4. The device of claim 3, wherein the compressive stresses exerted on the opposed surfaces of the saw blade are sufficient to clamp the saw blade.

5. The device of claim 3, wherein the cut surfaces of the cutting resistant element under compression exert a braking torque on the opposed surfaces of the saw blade, a frictional force sufficient to slow or stop the saw blade, or a frictional force sufficient to jam the saw blade between the cut surfaces.

6. The device of claim 1, wherein when the cutting device is a thermal cutting device, the cutting resistant element exerts a compressive force to feed material of the cutting resistant element at the opposed cut surfaces into a cutting region of the thermal cutting device.

7. The device of claim 1, wherein the cutting resistant element is formed of a metal or metal alloy, concrete, asphalt, a fiber-reinforced composite material, a fibrous material, an elastomeric material, a viscoelastic material, an oxygen-reactive material, or a combination thereof.

8. The device of claim 1, wherein the cutting resistant element comprises a bar or rod.

9. The device of claim 1, wherein the compressive loading element further comprises at least one stop at the first end or the second end of the cavity, wherein the at least one stop is detachable to allow the cutting resistant element to be loaded into the cavity and attachable to maintain the cutting resistant element under compression within the cavity.

10. The device of claim 1, wherein the compressive loading element further comprises post tensioned members within the substrate.

11. The device of claim 1, wherein the cavity extends along a vertically oriented axis, and the compressive loading element further comprises a weight of the cutting resistant element bearing on a bottom surface of the cavity or a weight of the substrate bearing on an upper end of the cutting resistant element.

12. The device of claim 1, wherein the cutting resistant element is disposed for spinning motion about an axis within the cavity.

13. A device to provide protection against a cutting threat, comprising:

a substrate, a cavity disposed within the substrate; and a cutting resistant element disposed within the cavity to exert compressive forces or frictional forces on a cutting device to slow or stop the cutting device when the cutting device cuts into the cutting resistant element, thereby impeding further cutting by the cutting device into the cutting resistant element;

wherein the substrate comprises concrete, a metal or metal alloy, a reinforced composite material, or a metal shell having an interior region filled with concrete.

14. A device to provide protection against a cutting threat, comprising:

a substrate, a cavity disposed within the substrate; and a cutting resistant element disposed within the cavity to exert compressive forces or frictional forces on a cutting device to slow or stop the cutting device when the cutting device cuts into the cutting resistant element, thereby impeding further cutting by the cutting device into the cutting resistant element;

wherein the substrate comprises an element of a bridge cable or a structural column or a load bearing member of a structure; or is configured to surround at least a portion of a periphery of a structural member, the structural member comprising a cable, a structural column, a structural beam, or a truss member.

15. The device of claim 1, wherein the cutting resistant element comprises a load bearing member of a structure.

16. The device of claim 1, wherein the cutting resistant element is disposed vertically within a structure.

17. A device to provide protection against a cutting threat, comprising:

a substrate, a cavity disposed within the substrate; and a cutting resistant element disposed within the cavity to exert compressive forces or frictional forces on a cutting device to slow or stop the cutting device when the cutting device cuts into the cutting resistant element, thereby impeding further cutting by the cutting device into the cutting resistant element;

wherein the device comprises at least a portion of a security device, wherein the security device is a safe, a security door, or a bicycle lock.

18. A structure comprising:

a structural member that bears one or more of a compressive load, a tensile load, or a bending load; and a device to provide protection against a cutting threat disposed to protect the structural member, the device comprising:

a substrate, a cavity disposed within the substrate; and a cutting resistant element disposed within the cavity to exert compressive forces or frictional forces on a cutting device to slow or stop the cutting device when the cutting device cuts into the cutting resistant element, thereby impeding further cutting by the cutting device into the cutting resistant element.

19. A method for protecting a structure against a cutting threat, comprising:

providing a device to provide protection against a cutting threat, comprising:

a substrate, a cavity disposed within the substrate; and a cutting resistant element disposed within the cavity to exert compressive forces or frictional forces on a cutting device to slow or stop the cutting device when the cutting device cuts into the cutting resistant element, thereby impeding further cutting by the cutting device not the cutting resistant element; and disposing the device in a position to protect a structural member of the structure that bears a compressive load, a tensile, load, or a bending load.

20. A device to provide protection against a cutting threat, comprising:

a substrate, a cavity disposed within the substrate; and a cutting resistant element disposed within the cavity to exert compressive forces or frictional forces on a cutting device to slow or stop the cutting device when the cutting device cuts into the cutting resistant element, thereby impeding further cutting by the cutting device into the cutting resistant element;

wherein the cutting resistant element comprises a blade stopping member configured to exert a compressive stress on opposed surfaces of a saw blade cutting into the blade stopping member, and further comprising a second cutting resistant element comprising a thermal resistant member configured to feed material under compression to a thermal cutting device.

21. A device to provide protection against a cutting threat, comprising:

a substrate, a cavity disposed within the substrate; and a cutting resistant element disposed within the cavity to exert compressive forces or frictional forces on a cutting device to slow or stop the cutting device when the cutting device cuts into the cutting resistant element, thereby impeding further cutting by the cutting device into the cutting resistant element;

wherein the cavity within the substrate extends along an axis, and the cutting resistant element is disposed to translate along the axis within the cavity and is maintained under compression within the cavity by the compressive forces extending along the axis, and further comprising a compressive loading element disposed to maintain the cutting resistant element under compression within the cavity, wherein when a cutting device cuts into the cutting resistant element, the compressive forces push opposed cut surfaces of the cutting resistant element into the cutting device, thereby impeding further cutting by the cutting device into the cutting resistant element, and when the cutting device is a saw blade, the cutting resistant element exerts a compressive stress on opposed surfaces of the saw blade cutting into the cutting resistant element;

further comprising a second cavity disposed within the substrate, and a second cutting resistant element disposed within and maintained under compression within the second cavity to exert a compressive force to feed material of the second cutting resistant element at opposed cut surfaces into a cutting region of a thermal cutting device, and further comprising a further compressive loading element disposed to maintain the second cutting resistant element under compression within the second cavity, wherein when the cutting device is a thermal cutting device, the second cutting resistant element exerts a compressive force to feed material of the second cutting resistant element at the opposed cut surfaces into a cutting region of the thermal cutting device;

further comprising a further cutting resistant element maintained under compression within a further cavity in the substrate by a further compressive force extending generally parallel to the further cavity; and wherein the substrate comprises a metal shell having an interior region.

22. The device of claim 1, wherein the cavity has a cross-sectional configuration orthogonal to the axis of elongation and sized and configured to conform to a cross-sectional configuration of the cutting resistant element to minimize movement of the cutting resistant element transverse to the axis of elongation.

* * * * *